United States Patent [19]

Rieth

[11] 3,994,126

[45] Nov. 30, 1976

[54] EXPANSIBLE LINKAGE AND METHODS OF MAKING EXPANSIBLE LINKAGES

[75] Inventor: Kurt Albert Rieth, Warwick, R.I.

[73] Assignee: Textron, Inc., Providence, R.I.

[22] Filed: Feb. 2, 1976

[21] Appl. No.: 654,529

[52] U.S. Cl. ..... 59/79 R; 59/79 B; 59/80; 59/35 R; 63/5 R

[51] Int. Cl.[2] ..... F16G 13/00

[58] Field of Search ..... 59/79 B, 79 R, 80, 35, 59/31, 82; 63/5 R

[56] References Cited

UNITED STATES PATENTS

| | | | |
|---|---|---|---|
| 3,416,305 | 12/1968 | Rieth | 59/79 R |
| 3,494,123 | 2/1970 | Kremer | 59/35 |
| 3,844,136 | 10/1974 | Rieth et al. | 63/4 |

*Primary Examiner*—Milton S. Mehr

[57] ABSTRACT

This disclosure is directed to expansible linkages for use in the manufacture of expansible bands such as wrist watchbands, identification bracelets, and other articles of jewelry, the sides of which when viewed from the top are provided with attractive configurations, for example, tapered from their ends toward their center portions or vice versa. It is also directed to novel methods of making such expansible linkages.

The expansible linkage includes two rows of links and resilient means associated with the links for returning them from expanded to contracted positions. It also includes a series of ornamental top shells attached to the top links. The ends of the top shells extend outwardly from the ends of at least a majority of the top links. Solid inserts are positioned within the outwardly extending portions of the top shells and the outer ends of the combined top shells and inserts are machined to provide any desired configuration to the sides of the linkage when the linkage is viewed from the top.

The method includes the steps of assembling an expansible linkage without top shells and fabricating a plurality of top shells, at least a majority of which are longer than the basic expansible linkage and which have hollow end portions. Other steps include fabricating a plurality of solid inserts and securing the inserts within the hollow end portions of the top shells. Other steps include attaching the combined top shells and inserts to the top links of the basic expansible linkage and then machining at least the majority of the outwardly extending ends of the combined top shells and inserts to provide the desired configurations to the sides of the linkage when it is viewed from the top.

18 Claims, 34 Drawing Figures

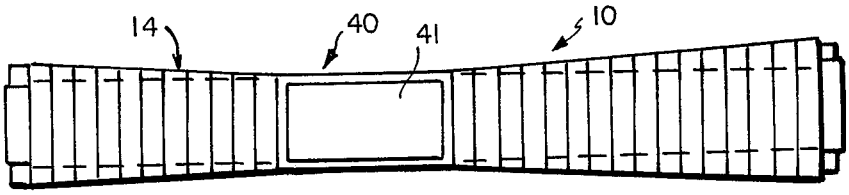
FIG.1
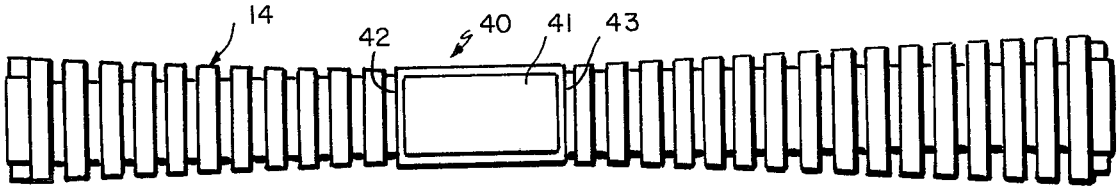
FIG.2
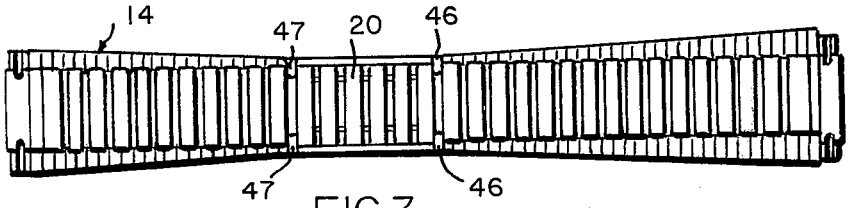
FIG.3
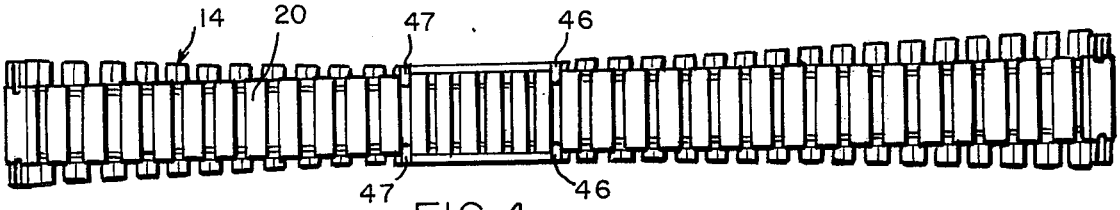
FIG.4
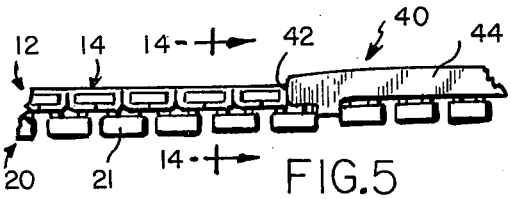
FIG.5
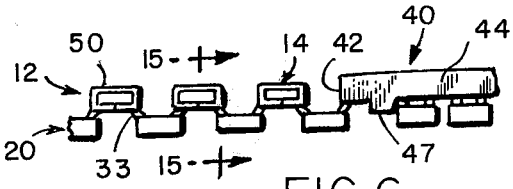
FIG.6
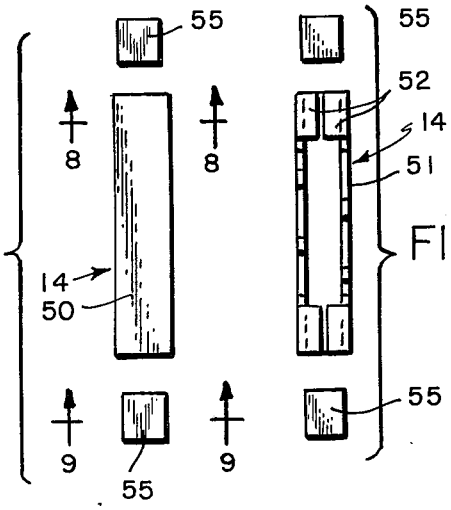
FIG. 7
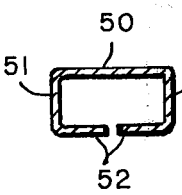
FIG.7A
FIG.8
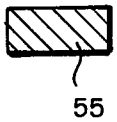
FIG.9

EXPANSIBLE LINKAGE AND METHODS OF MAKING EXPANSIBLE LINKAGES

BACKGROUND OF THE INVENTION

There has been a long-felt need for an expansible linkage for use in the manufacture of expansible bands such as wrist watch bands, identification bracelets and other articles of jewelry, the sides of which when viewed from the top are provided with attractive configurations, for example tapered from their ends towards their central portions or vice versa.

There has also been a long-felt need for a method of making such expansible linkages.

The following patents disclose various constructions of non-expansible bands which are unsatisfactory for use in manufacturing expansible bands.

| Country | Patent No. | Date | Inventor |
|---|---|---|---|
| United States | 2,079,386 | May 4, 1937 | Schofer |
| France | 1,329,121 | Apr. 29, 1963 | Fischer |
| United States | 3,195,301 | July 20, 1965 | Bello |
| Germany | 1,232,776 | Jan. 19, 1967 | Rodi & Wienenberger |
| United States | 3,609,963 | Oct. 5, 1971 | Ichinose |
| United States | 3,690,064 | Sept. 12, 1972 | Pompeo |

While Schaudel U.S. Pat. No. 3,846,976 dated Nov. 12, 1974 discloses an expansible linkage for a wrist watch band the sides of which increase in width from the central portion towards its ends, it would be very expensive to manufacture such a linkage because at least the solid members 4 adjacent to each end of the band must be made of different configurations and they are very thick. Furthermore the linkage is not provided with ornamental top shells and consequently it would be very expensive to provide the upper surfaces of the solid elements 2 and 4 with ornamental surfaces having different designs for different watch bands. In addition, the Schaudel method of manufacture is very expensive. So far as I know, expansible watch bands of the Schaudel construction have not been made or sold in this country.

BRIEF SUMMARY OF THE INVENTION

One object of this invention is to provide a new expansible linkage the sides of which may be provided with any desired configuration when viewed from the top.

Another object is to provide such an expansible linkage which is economical to manufacture and is durable in use.

A further object is to provide such a linkage which includes thin ornamental top shells which can be easily provided with a plurality of designs by impressing the designs upon the top shells before they are assembled with the top links of the linkage to provide linkages with many different ornamental appearances.

A still further object is to provide such an expansible linkage which comprises two rows of links when viewed from the side.

Yet another object is to provide new and economical methods of making such an expansible linkage.

Further objects and advantages of this invention will be apparent to persons skilled in the art from the following description taken in conjunction with the accompanying drawings.

In general an expansible linkage embodying this invention includes a row of top links and a row of bottom links, means interconnecting the links of each row with the links of the other row to provide displacement of the links relative to each other when the linkage is stretched longitudinally from a contracted to an expanded position, and resilient means associated with the links for resisting the displacement of them and for returning them from expanded to contracted positions upon release of the longitudinal stretching force. It also includes ornamental top shells associated with the top links and the ends of the top shells extend outwardly from the ends of at least the majority of the top links. Solid inserts are positioned within the outwardly extending portions of the top shells. Means are provided for securing the inserts to the outwardly extending portions of the top shells and the outer ends of the combined top shells and inserts are progressively ground to provide any desired configuration to the sides of the linkage when it is viewed from the top.

In a preferred embodiment of the expansible linkage, the outwardly extending portions of the top shells are hollow and the cross sections of the inserts are smaller than the cross sections of the hollow outwardly extending portions of the top shells so that the inserts may be slid longitudinally into the hollow outwardly extending portions prior to securing them to the outwardly extending portions.

In one embodiment, the inserts are secured to the outwardly extending portions of the top shells by solder, in another embodiment by at least one weldment and in another by adhesive.

In another embodiment the cross section of each insert is slightly greater than the cross section of the opening in the hollow end portion of the top shell with which it is to be associated and the insert is forced into the opening so that the pressure exerted by the hollow end portion of the top shell secures the insert therein.

In still another embodiment the end portions of the top shells are folded about the inserts and the pressure created by this folding step secures the inserts within the end portions of the top shells.

In a preferred embodiment of the method of this invention, one step comprises assembling an expansible linkage which includes a row of top links and a row of bottom links, means interconnecting the links of each row with the links of the other row to provide displacement of the links relative to each other when the linkage is stretched longitudinally from a contracted to an expanded position and resilient means associated with said links for resisting the displacement of said links and for returning them from expanded to contracted positions upon release of the longitudinal stretching force. In another step, a plurality of ornamental top shells are fabricated for assembly with at least a majority of the top links of the linkage, the top shells being longer than the top links and having hollow end portions which will extend outwardly from the ends of the top links when assembled with them. Other steps comprise fabricating a plurality of solid inserts, inserting the inserts into the hollow end portions of the top shells and securing the inserts respectively within the hollow end portions of the top shells. Then the combined top shells and inserts are secured to the top links of the linkage. Then at least the majority of the outwardly extending ends of the combined top shells and inserts are progressively machined to provide the desired configuration to the sides of the linkage when it is viewed from the top. As used in this specification and the claims, "machining" includes machining, grinding and chopping.

In one embodiment of the method, the inserts are coated with solder prior to inserting them into the outwardly extending portions of the top shells and then the combined top shells and inserts are heated to melt the solder and bond the inserts to the outwardly extending portions of the top shells.

In another embodiment of the method, the outwardly extending portions of the top shells are welded to the inserts after the inserts have been inserted into the outwardly extending portions of the top shells.

In another embodiment of the method, the securing step comprises forcing an adhesive between the surfaces of the inserts and the adjacent surfaces of the outwardly extending portions of the top shells.

In still another embodiment of the method, the cross section of each insert is slightly greater than the cross section of the opening in the hollow end portion of the top shell with which it is to be associated and the insert is forced into the opening so that the pressure exerted by the hollow end portion of the top shell secures the insert therein.

In yet another embodiment of the method, the inserts are secured within the end portions of the top shells by folding the end portions of the top shells about the inserts when the top shells are formed.

In another embodiment of the method, the linkage is polished after the machining step.

In yet another embodiment of the method, at least the outer ends of the combined top shells and inserts are electroplated with gold after the machining step.

It will be apparent to persons skilled in the art that this invention has solved the above described long-felt need and satisfied the above-described objects.

BRIEF DESCRIPTION OF THE DRAWINGS

FIG. 1 is a top plan view of the first embodiment of an expansible linkage embodying the invention, the expansible linkage being shown in contracted position;

FIG. 2 is a top plan view of the linkage shown in FIG. 1 in an expanded position;

FIG. 3 is a bottom plan view of the linkage of FIG. 1 in contracted position;

FIG. 4 is a bottom plan view of the linkage of FIG. 1 in an expanded position;

FIG. 5 is an enlarged side view of the contracted linkage of FIG. 1;

FIG. 6 is an enlarged side view of the linkage of FIG. 1 in an expanded position;

FIG. 7 is an enlarged exploded view looking at the top of one of the top shells of the linkage of FIG. 1 and a pair of inserts positioned to be inserted into the ends of the top shells;

FIG. 7A is an enlarged exploded view of a top shell looking at the bottom of the linkage of FIG. 1 with a pair of inserts in positions to be inserted into the hollow ends of the top shell;

FIG. 8 is an enlarged section of one end of a top shell taken on the lines 8—8 of FIG. 7;

FIG. 9 is an enlarged section of one of the inserts taken on the lines 9—9 of FIG. 8;

DETAILED DESCRIPTION OF THE FIRST EMBODIMENT

Except for the novel top shell and inserts, the expansible linkage 10 shown in FIGS. 1 through 10 of the drawings includes linkages of the type shown in U.S. Pat. Nos. 3,307,348 dated Mar. 7, 1967 to Vanover; 3,416,305 dated Dec. 17, 1968 to Rieth; 2,689,450 dated Sept. 21, 1954 to Stiegele; 3,543,507 dated Dec. 1, 1970 to Vanover and Flaig; 3,587,226 dated June 28, 1971 to Rieth; 3,705,490 dated Dec. 12, 1972 to Ripley; and 3,897,612 dated Aug. 5, 1975 to Bert.

Figure 17:
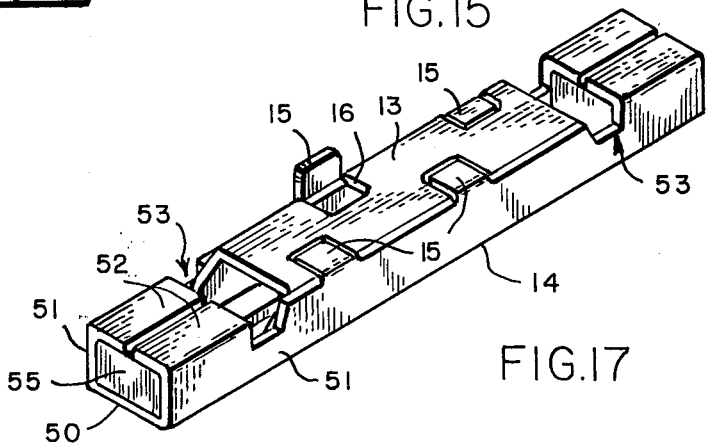
FIG. 17 is an isometric view looking at the bottom of the top link and assembled top shell with one tab of the top shell shown in a position before being bent inwardly and with the leaf spring and connecting members omitted.
Figure 18:
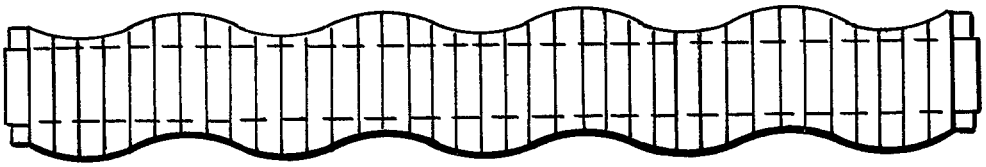
FIGS. 18 through 22 are diagrammatic top plan views of linkages of the type disclosed in FIGS. 1 through 17 showing other variations of side contours which can be provided by different machinings of the ends of the combined top shells and inserts, the ends of the bottom links being shown in dotted lines.
Figure 19:
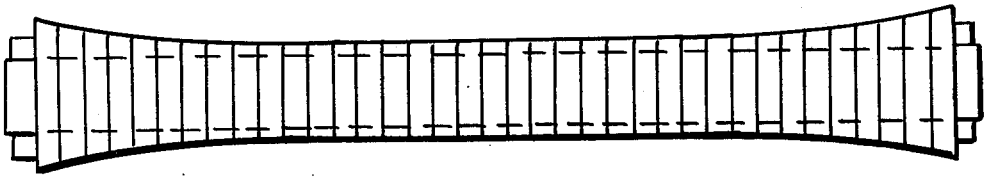
Figure 20:
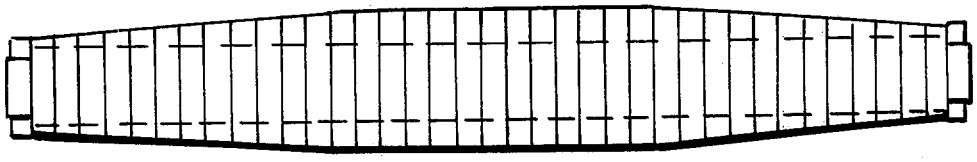
Figure 21:
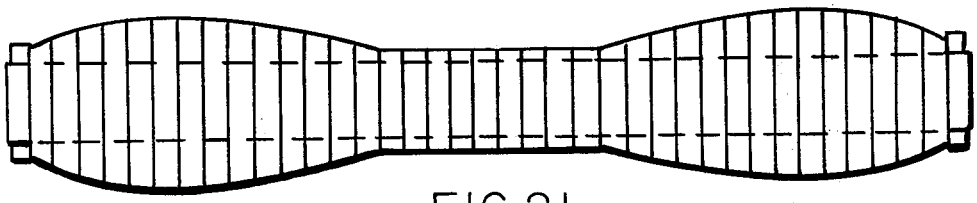
Figure 22:
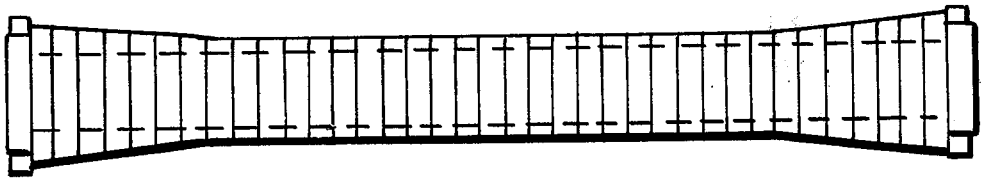

The linkage comprises two rows of overlapping staggered links, a top row 12 and a bottom row 20 (see FIGS. 3, 4, 5, 6, 14 and 15) each link extending in a direction generally transverse to the length of the linkage when viewed from the top or bottom. The top link 13 (FIGS. 14, 15 and 17) is provided with an ornamental top shell 14 which is secured to the top link by four tabs 15 which are bent inwardly into notches 16 provided in the inner wall of the top link as shown in FIG. 17.

Figure 12:
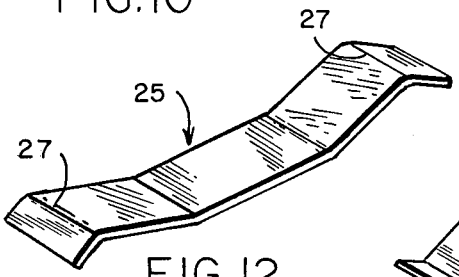
FIG. 12 is an isometric view of one of the leaf springs used in the top links.
Figure 12X:
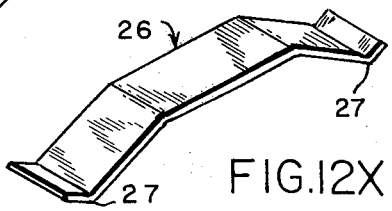
FIG. 12X is an isometric view of one of the leaf springs used in the bottom links.

There is a leaf spring located in each top link and in each bottom link. The leaf spring 25 for the top link is shown in FIG. 12 and the leaf spring 26 for the bottom link is shown in FIG. 12X. It is similar except that it is narrower since the bottom links are narrower than the top links as shown in FIGS. 5 and 6 to provide spaces between the sides of the bottom links when the linkage lies flat in contracted position.

Figure 13:
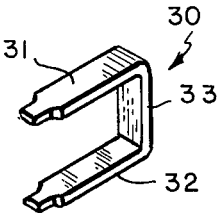
FIG. 13 is an isometric view of one of the connecting members.
Figure 14:
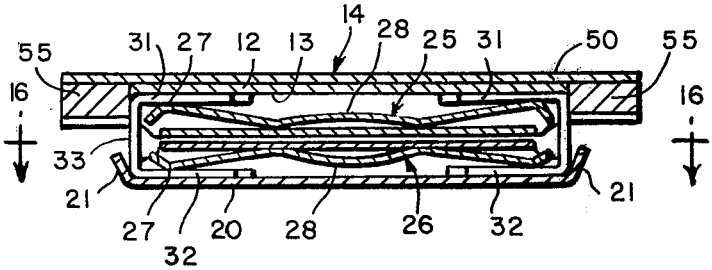
FIG. 14 is an enlarged section taken on the lines 14—14 of FIG. 5.
Figure 16:
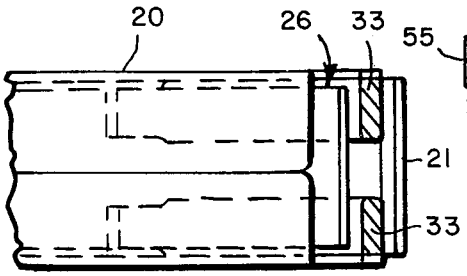
FIG. 16 is an enlarged horizontal section taken on the lines 16—16 of FIG. 14.
Figure 15:
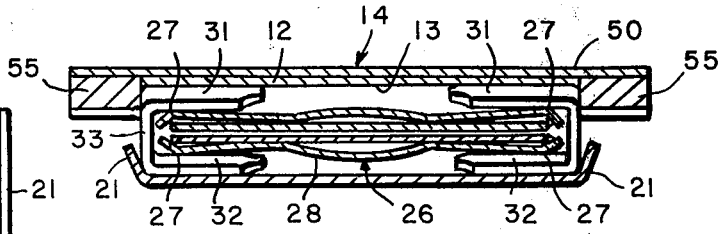
FIG. 15 is an enlarged section taken on the lines 15—15 of FIG. 6.

The links of the top row are connected to the links of the bottom row by U-shaped connecting members 30 (FIG. 13), the legs 31 and 32 of which are positioned between the bends 27 of the springs and the outer walls of the top and bottom links respectively as shown in FIGS. 14 and 15.

Tabs 21 are bent upwardly at the ends of the bottom links 20 to hold the U-shaped connecting members 30 in the links.

In assembled condition, the legs 31 and 32 of the connecting members extend within the links in a direction generally transverse to the length of the linkage. The legs 31 of two of the four connecting members in each top link are located within the top link near one side thereof, the other leg 32 of one of these connecting members is located within an adjacent link of the bottom row and the other leg 32 of the other connecting member is located within an adjacent link in the bottom row. The other two connecting members are located near the opposite side of the linkage and their legs are located within the links near the opposite sides in the same way. These connecting members are repeated to provide a linkage of the desired length.

To assemble the linkage, the leaf springs are inserted in the top and bottom links. This causes the ends of the springs to be deflected from their unloaded heights of FIGS. 12 and 12X to partially loaded heights. The legs of the connecting members are then inserted between the bends 27 of the springs and the outer walls of the links. This causes the ends of the springs to be further deflected to their working heights shown in FIG. 14 when the linkage is in its fully contracted position of FIGS. 1, 3, 5, 10 and 14. Then the tabs of the bottom links are bent upwardly to the positions shown in FIG. 14.

In the contracted position of FIG. 14, the central part 28 of each spring bears against an intermediate portion of the inner wall of the link and the bends 27 engages pairs of legs of the connecting members, thus resiliently urging the linkage to its fully contracted position shown in FIGS. 1, 3, 5, 10 and 14. When the linkage is expanded from the position shown in FIGS. 1, 3, 5, 10 and 14, the ends of the springs are further deflected from their working heights. This deflection of the springs is caused by the turning or rotating movements of the legs 31, 32 of the connecting members as shown in FIG. 15.

Upon release of the expanding or stretching force, the springs acting upon the legs of the connecting members return the linkage to its contracted position.

The member 40 may be used for adjusting the length of the linkage. It comprises the ornamental plate member 41 which is curved longitudinally to conform generally with the curvature of the wrist of the wearer. The plate member has a pair of end flanges 42 and 43, a pair of side flanges 44, a first pair of tabs 46—46, and a second pair of tabs 47—47 (FIGS. 2, 3, 4, 5 and 6).

In the embodiment shown in FIGS. 1, 2, 3, 4, 5, and 10, the top shells are omitted from seven of the top links which underlie the plate member 40.

The bendable tabs 46 and 47 detachably secure the member 40 to the linkage. A more detailed description of the construction and operation of the member 40 is found in U.S. Pat. No. 3,705,490 dated Dec. 12, 1972 to which reference is hereby made. The inclusion of the member 40 is not essential to the expansible linkage as claimed herein. When the member 40 is omitted, top shells are applied to all of the top links as shown in FIGS. 18 through 22.

The construction of the ornamental top shells 14 is new. Each top shell comprises a top wall 50, side walls 51, and bottom walls 52 which are adjacent to each end. They may be made of relatively thin gold-filled, stainless steel, or other materials. The upper surfaces of the top walls 50 may be easily provided with a plurality of designs before they are assembled with the top links of the linkage to provide linkages with many ornamental appearances.

Gaps 53 are provided between the ends of the central portions of the side walls and the end portions as shown in FIG. 17. These gaps accommodate the ends 33 of the connecting members when the linkage is stretched to any expanded position, for example, the position shown in FIGS. 6 and 15.

The outer ends of the bottom walls 52 of the top shells together with the adjacent portions of the side walls 51 and top wall 50 form hollow end portions which extend outwardly from the ends of at least the majority of the top links as shown in FIGS. 7A, 8, 14, 15 and 17.

A pair of solid inserts 55 is provided for the ends of each top shell. They may be made of a copper-nickel alloy called "18% nickel silver", stainless steel, pure nickel, inconel, monel, or other similar materials. In one embodiment, the cross sections of the inserts are slightly smaller than the openings in the hollow end portions of the top shells so that they may be inserted in those openings.

According to one embodiment of the method of this invention, the inserts are coated with solder before they are inserted in said openings and, after they have been inserted, the combined top shells and inserts are heated to melt the solder and bond the inserts to the end portions of the top shells.

In another embodiment of the method, the outwardly extending portions of the top shells are welded to the inserts after the inserts have been inserted in said openings.

In another embodiment of the method, an adhesive is forced between the surfaces of the inserts and the adjacent surfaces of the outwardly extending portions of the top shells.

In still another embodiment of the method, the cross section of each insert is slightly greater than the cross section of the opening in the hollow end portion of the top shell with which it is to be associated and the insert is forced into said opening and the pressure exerted by the hollow end portion of the top shell secures the insert therein.

In yet another embodiment of the method, the inserts are secured within the end portions of the top shells by folding the end portions of the top shells about the inserts when the top shells are formed.

Other methods of securing the inserts within the outwardly extending portions of the top shells will be apparent to persons skilled in the art.

The combined top shells and inserts are secured to the top links 12 of the linkage by superimposing each combined top shell and insert upon a top link and then bending the tabs 15 into the notches 16 as shown in FIG. 17. The resultant linkage is shown in FIG. 10.

Figure 10:
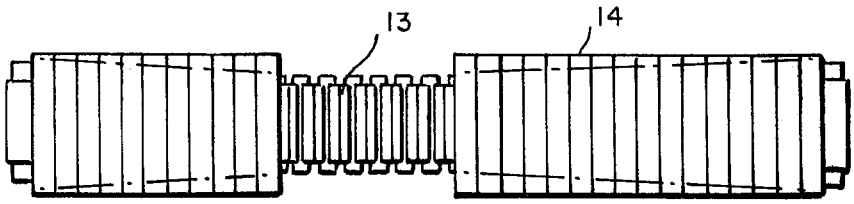
FIG. 10 is a top plan view of the linkage shown in FIG. 1 with the central plate-like length adjustment member removed showing in dot dash the lines upon which the combined ends of the inserts and top shells are to be machined to provide the tapered appearance shown in FIG. 1.
Figure 11:
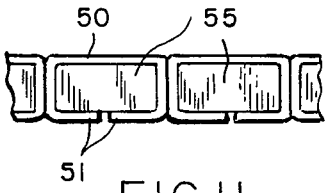
FIG. 11 is an enlarged side view of the top shells and inserts after the inserts have been secured within the outwardly extending portions of the top shell.

To form the linkage shown in FIG. 1 from the linkage shown in FIG. 10, the outwardly extending ends of the combined top shells and inserts are machined to provide the tapered effect shown in FIG. 1.

Then, if the member 40 is used, it is attached at the center of the linkage.

The entire linkage is then polished.

If the top shells are made of gold-filled material and the inserts are made of nickel, stainless steel, 18% nickel-silver or other materials which are not of a gold color, their outer ends present contrasting colors. While such contrasting colors are acceptable to some customers, a uniform gold appearance may be provided for the outer ends of the inserts by electroplating them or the entire linkage with gold.

Any other variations of side contours of the expansible linkage may be provided by varying the machining step. Some variations are shown in FIGS. 18–22.

The expansible linkage of this embodiment is new, economical to manufacture, durable in use, different surface designs of the top shells may easily be provided, and the sides of the linkage may be provided with any desired configuration when the linkage is viewed from the top.

DETAILED DESCRIPTION OF THE SECOND EMBODIMENT

The second embodiment is shown in FIGS. 23–26 of the drawings. This type of construction is shown and described in Augenstein, U.S. Pat. No. 2,515,817, dated July 18, 1950, and it is commonly referred to as a lazy tongs or X-type of expansible linkage.

It comprises a row of top links 60 and a row of bottom links 65. Each bottom link is provided with three hollow tubular elements 66, 67 and 68. The upper end of the central tubular element 67 passes through an opening 61 at the center of a first top link 60A and is peened over at 67A to pivotally secure the bottom link and the top link 60A together.

One end of the tubular element 68 extends through an opening 62 at one end of an adjacent top link 60B and is peened over at 60A to pivotally secure that end of the bottom link and the top link 60B together.

One end of the tubular element 66 extends through an opening near the end of the top link 60C and is peened over to pivotally secure that end of the bottom link to the top link 60C.

In this way a series of superimposed top and bottom links are pivotally secured together in a lazy tongs or X arrangement, as is well known in the prior art.

A plurality of coil springs 70 are provided, one for each of the central tubular elements 67. The coil part 70A of each spring is inserted in a central tubular element 67 of a top link. The downwardly extending end 70B of each coil spring is inserted in a tubular element 68 at one end of the same top link. The other end of the coil spring engages one side of the bottom shell 69, which is secured to the underlying bottom link.

Figure 23:
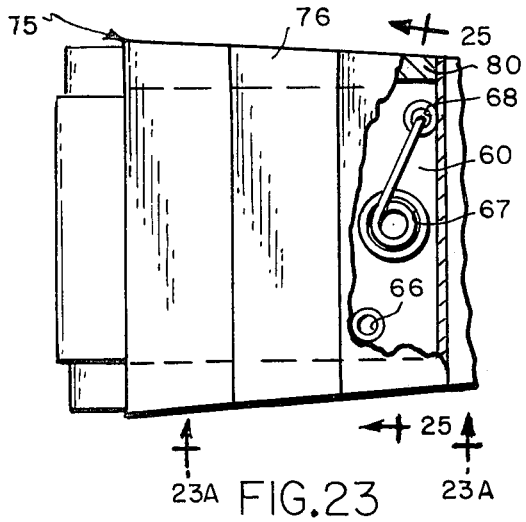
FIG. 23 is a top plan view of a second embodiment of an expansible linkage embodying the invention with one of the top shells broken away to show a top link and one end of one of the coil springs used to return the linkage from an expanded position to contracted position.
Figure 24:
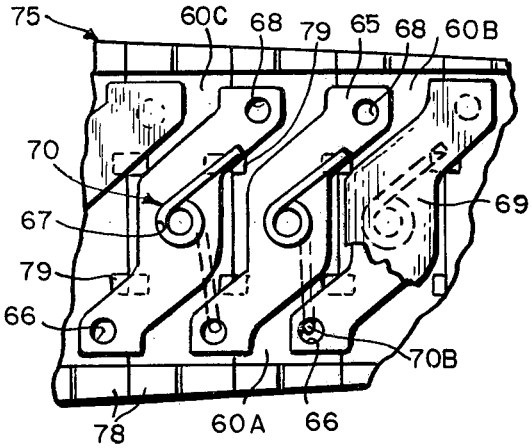
FIG. 24 is a bottom plane view of a portion of the linkage shown in FIG. 23 with the bottom shells omitted from two of the bottom links.
Figure 25:
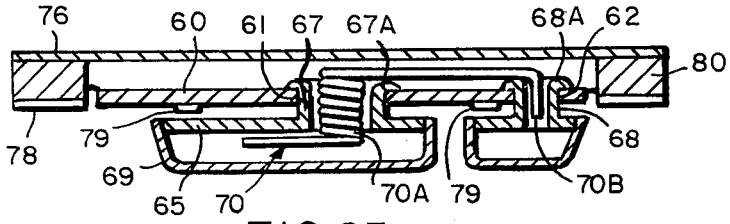
FIG. 25 is an enlarged section taken on the lines 25—25 of FIG. 23.
Figure 26:
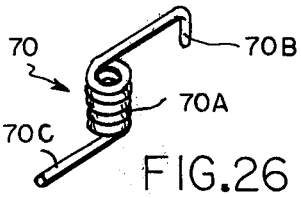
FIG. 26 is an isometric view of one of the coil springs used in the embodiment of FIGS. 23 to 25.

Thus, the springs 70 resist the displacement of the links upon exertion of a longitudinal stretching force and, upon the release of the stretching force, they return the links to their contracted positions shown in FIGS. 23 and 24.

Figure 23A:
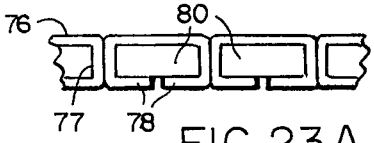
FIG. 23A is a side view of the linkage of FIG. 23 looking in the direction of the arrows 23A-23A of FIG. 23 showing the top shells and inserts but omitting the bottom links.
Figure 29A:
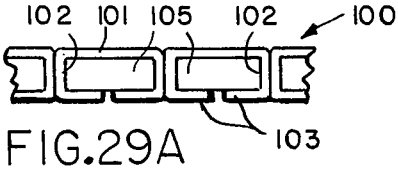
FIG. 29A is a side view looking in the direction of the arrows 29A—29A of FIG. 27 showing the top shells and inserts but omitting the bottom links.

As in the first embodiment, each top link 60 is provided with a novel top shell 75, the outer ends of which are provided with hollow end portions, each of which is formed by a top wall 76, side walls 77 and a bottom wall 78—78 as shown in FIG. 23A. Solid inserts 80 are secured within the hollow end portions by soldering, welding, adhesive, forcing, or folding the outer ends of the top shells about the inserts or the like as described above with respect to the first embodiment.

The top shells are secured to the top links 60 by tabs 79 which are bent inwardly from the side walls of the central portions of the top shells and beneath the top link 60. The central portions of the top shells are not provided with bottom walls - see FIGS. 24 and 25.

After the linkage has been assembled, the outwardly extending ends of the combined top shells and solid inserts are machined to provide any desired configuration for the sides of the linkage, for example, the tapered configuration shown in FIGS. 23 and 24 or any of the other configurations shown in FIGS. 18–22.

After the machining step, the linkage is polished and/or electroplated with gold as described above with respect to the first embodiment.

The links may be made of stainless steel or any other desired material. The top shells and the inserts may be made of the materials described above with respect to the first embodiment.

The expansible linkage of the second embodiment, and the methods of making it, satisfy the long-felt need and the objects of the invention as stated above for the first embodiment.

DETAILED DESCRIPTION OF THE THIRD EMBODIMENT

The third embodiment is shown in FIGS. 27–30 of the drawings. This type of construction is shown and described in Augenstein U.S. Pat. No. 2,267,967 dated Dec. 30, 1941 and is commonly referred to as a Z type or two-pivot type of expansible linkage.

It comprises a row of top links 82 and a row of bottom links 90. Each top link is provided with two hollow tubular elements 83 and 84.

The lower end of the tubular element 83 passes through an opening at one end of the bottom link 90A and is peened over at 83A to pivotally secure one end of the bottom link 90A to one end of the top link 82A.

The lower end of a tubular element 84 passes through an opening near the other end of the bottom link 90A and is peened over at 84A to pivotally secure the other end of the bottom link 90A to one end of the top link 82B.

In this way, a series of superimposed top and bottom links are pivotally secured together in a two-pivot or Z arrangement as is well known in the prior art.

A plurality of coil springs 95 are provided, one for each of the tubular pivots 83 and 84. Each spring comprises a coil part 95A and two outwardly extending fingers 95B and 95C. The finger 95C is provided with an extension 95D which extends at an angle of about 90° from the finger.

Figure 27:
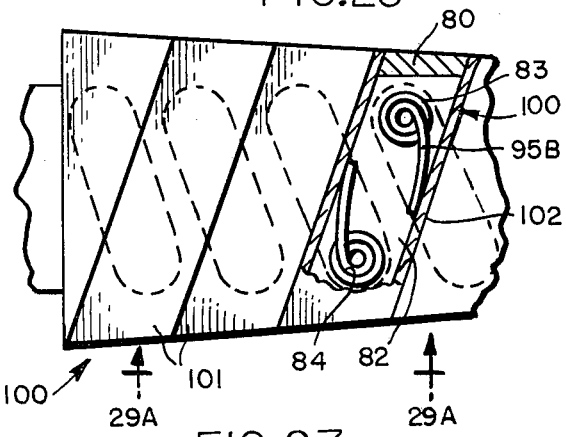
FIG. 27 is a top plan view of a third embodiment of expansible linkage embodying the invention with one of the top shells broken away to show the ends of two of the coil springs used to return the linkage from an expanded position to contracted position.
Figure 28:
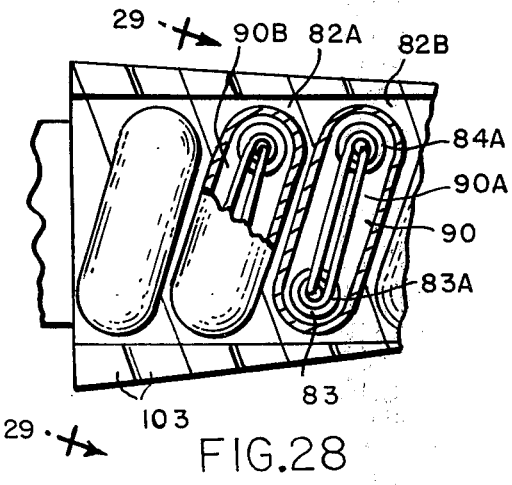
FIG. 28 is a bottom plan view of a portion of the linkage shown in FIG. 27 with one of the bottom shells broken away to show the pivots and coil springs used to return the linkage from an expanded position to contracted position.
Figure 29:
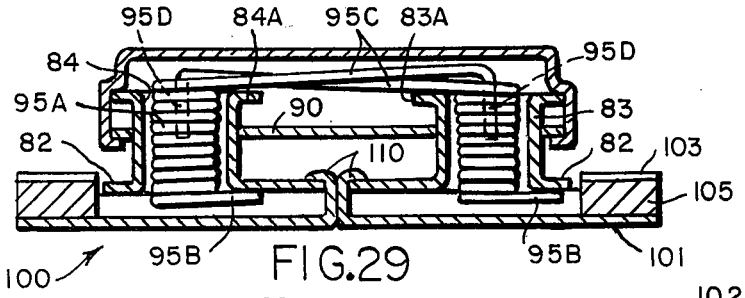
FIG. 29 is an enlarged section taken on the lines 29—29 of FIG. 28.
Figure 30:
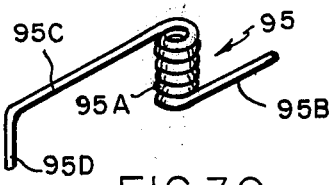
FIG. 30 is an isometric view of one of the coil springs used in this embodiment.

The springs 95 are arranged in cooperating pairs with their coils extending through the hollow tubular pivots 83 and 84 and the extensions 95D extend into the coils 95A as shown in FIGS. 28 and 29 of the drawings. The ends of the fingers 95B engage the side walls 102 of a top shell 100 as shown in FIG. 27.

Thus, the springs cooperate to resist the displacement of the links upon the exertion of a longitudinal stretching force, and upon release of the stretching force, they return the links to their contracted positions shown in FIGS. 27 and 28.

As in the first and second embodiments, each top link 82 is provided with a novel top shell 100, the outer ends of which are provided with hollow end portions, each of which is formed by a top wall 101, side walls 102, and a bottom wall 103—103 as shown in FIGS. 27, 28, 29 and 29A. Solid inserts 105 are secured within the hollow end portions of the top links by soldering, welding, adhesive, forcing, or folding the outer ends of the top shells about the inserts, or the like, as described above with respect to the first embodiment.

The top shells 100 are secured to the top links 82 by tabs 110 which are bent inwardly from the central portions of the top shells and beneath the top links 82. The central portions of the top shells are not provided with bottom walls.

After the linkage has been assembled, the outwardly extending ends of the combined top shells and solid inserts are machined to provide any desired configuration for the sides of the linkage, for example, the tapered configuration shown in FIGS. 27 and 28 or any of the other configurations shown in FIGS. 18–22.

After the machining step, the linkage is polished and/or electroplated with gold as described above with respect to the first embodiment.

The links may be made of stainless steel or any other desired material. The top shells and inserts may be made of any of the materials described above with respect to the first embodiment.

The expansible linkage of the third embodiment and the methods of making it satisfy the long-felt need and the objects of the invention as stated above for the first and second embodiments.

While three desirable embodiments of expansible linkages embodying the invention have been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

While several desirable embodiments of methods of making the expansible linkages of this invention have been described, it is to be understood that this disclosure is for the purpose of illustration only and that the substitution of equivalent method steps for those described herein may be made without departing from the spirit and scope of the method inventions as set forth in the appended claims.

I claim:

1. In an expansible linkage including in combination,
a row of top links and a row of bottom links,
means interconnecting the links of each row with the links of the other row to provide displacement of the links relative to each other when the linkage is stretched longitudinally from a contracted to an expanded position, and
resilient means associated with said links for resisting the displacement of said links and for returning them from expanded to contracted positions upon release of the longitudinal stretching force,
the improvement comprising,
ornamental top shells associated with said top links, the ends of said top shells extending outwardly from the ends of at least the majority of said top links,
solid inserts positioned within the outwardly extending portions of the top shells,
means for securing the inserts to the outwardly extending portions of the top shells, and
the outer ends of said combined top shells and inserts being machined to provide any desired configuration to the sides of the linkage when the linkage is viewed from the top.

2. A linkage according to claim 1 wherein the outwardly extending portions of the top shells are hollow and the cross sections of the inserts are smaller than the cross sections of the hollow outwardly extending portions of the top shells, whereby the inserts may be inserted longitudinally into said hollow outwardly extending portions prior to securing them to said outwardly extending portions.

3. A linkage according to claim 1 wherein the means for securing the inserts to the outwardly extending portions of the top shells comprises solder.

4. A linkage according to claim 1 wherein the means for securing the inserts to the outwardly extending portions of the top shells comprises at least one weldment.

5. A linkage according to claim 1 wherein the means for securing the inserts to the outwardly extending portions of the top shells comprises adhesive.

6. A linkage according to claim 1 wherein the means for securing the inserts to the outwardly extending portions of the top shells comprises pressure exerted by the outwardly extending portions of the top shells against the adjacent surfaces of the inserts.

7. A linkage according to claim 6 wherein the pressure is created by forcing the inserts into the outer ends of the outwardly extending portions of the top shells.

8. A linkage according to claim 6 wherein the pressure is created by folding the outwardly extending ends of the top shells about the inserts when the top shells are formed.

9. The method of making an expansible linkage comprising the step of assembling an expansible linkage which includes a row of top links and a row of bottom links, means interconnecting the links of each row with the links of the other row to provide displacement of the links relative to each other when the linkage is stretched longitudinally from a contracted to an expanded position and resilient means associated with said links for resisting the displacement of said links and for returning them from expanded to contracted positions upon release of the longitudinal stretching force, fabricating a plurality of ornamental top shells for assembly with at least a majority of the top links of the linkage, said top shells being longer than the top links and having hollow end portions which will extend outwardly from the ends of the top links when assembled with them, fabricating a plurality of solid inserts, inserting the inserts into the hollow end portions of the top shells, securing the inserts respectively within the hollow end portions of the top shells, securing the combined top shells and inserts to the top links of the linkage, and machining at least the majority of the outwardly extending ends of the combined top shells and inserts to provide the desired configuration to the sides of the linkage when it is viewed from the top.

10. A method according to claim 9 which also comprises the steps of:

coating the inserts with solder prior to inserting them into the outwardly extending portions of the top shells, and heating the combined top shells and inserts to melt the solder and bond the inserts to the end portions of the top shells.

11. A method according to claim 9 wherein the securing step comprises the step of welding the outwardly extending portions of the top shells to the inserts after the inserts have been inserted into the outwardly extending portions of the top shells.

12. A method according to claim 9 wherein the securing step comprises forcing an adhesive between the surfaces of the inserts and the adjacent surfaces of the outwardly extending portions of the top shells.

13. A method according to claim 9 wherein the cross section of each insert is slightly greater than the cross section of the opening in the hollow end portion of the top shell with which it is to be associated and the insert is forced into said opening whereby the pressure exerted by the hollow end portion of the top shell secures the insert therein.

14. A method according to claim 9 which also comprises the step of polishing the linkage after the machining step.

15. A method according to claim 9 which also comprises the step of electroplating at least the outer ends of the combined top shells and inserts with gold after the machining step.

16. The method of making an expansible linkage comprising the steps of assembling an expansible linkage which includes a row of top links and a row of bottom links, means interconnecting the links of each row with the links of the other row to provide displacement of the links relative to each other when the linkage is stretched longitudinally from a contracted to an expanded position and resilient means associated with said links for resisting the displacement of said links and for returning them from expanded to contracted positions upon release of the longitudinal stretching force, fabricating a plurality of solid inserts, fabricating a plurality of ornamental top shells for assembly with at least a majority of the top links of the linkage, said top shells being longer than the top links, securing the inserts respectively within the end portions of the top shells by folding the end portions of the top shells about the inserts, securing the combined top shells and inserts to the top links of the linkage, and machining at least the majority of the outwardly extending ends of the combined top shells and inserts to provide the desired configuration to the sides of the linkage when it is viewed from the top.

17. A method according to claim 16 which also comprises the step of polishing the linkage after the machining step.

18. A method according to claim 16 which also comprises the step of electroplating at least the outer ends of the combined top shells and inserts with gold after the machining step.

* * * * *